US009772168B2

(12) United States Patent
Russomanno

(10) Patent No.: US 9,772,168 B2
(45) Date of Patent: Sep. 26, 2017

(54) POWER GRIP ZAPPER GLOVE

(71) Applicant: Anthony Patrick Russomanno, Newbury Park, CA (US)

(72) Inventor: Anthony Patrick Russomanno, Newbury Park, CA (US)

( * ) Notice: Subject to any disclaimer, the term of this patent is extended or adjusted under 35 U.S.C. 154(b) by 65 days.

(21) Appl. No.: 15/000,038

(22) Filed: Jan. 19, 2016

(65) Prior Publication Data

US 2016/0216083 A1 Jul. 28, 2016

Related U.S. Application Data

(60) Provisional application No. 62/108,176, filed on Jan. 27, 2015.

(51) Int. Cl.
*F41H 13/00* (2006.01)
*A41D 19/015* (2006.01)

(52) U.S. Cl.
CPC ..... *F41H 13/0018* (2013.01); *A41D 19/015* (2013.01)

(58) Field of Classification Search
CPC ..... F41H 13/0018; A41D 19/015
See application file for complete search history.

(56) References Cited

U.S. PATENT DOCUMENTS 1,915,721 A * 6/1933 Henriquez Diaz Cirilo ..... F41H 13/0018 128/879
4,337,496 A * 6/1982 Laird ..... F41B 15/04 231/7
5,367,712 A * 11/1994 Smith ..... A63B 71/143 2/161.1
7,206,183 B2 * 4/2007 Sikes ..... H05C 1/06 361/232
7,477,504 B1 * 1/2009 Delida ..... F41H 13/0018 361/230
8,991,085 B1 * 3/2015 Knapp ..... F41H 13/0018 361/232
9,042,077 B2 * 5/2015 Jones ..... F41H 13/0018 361/232
9,086,256 B2 * 7/2015 Schweitzer ..... F41H 13/0018
2004/0154071 A1 * 8/2004 Frahm ..... F41H 13/0018 2/160
2015/0040880 A1 * 2/2015 Tseng ..... F41H 13/0018 124/71
2016/0324258 A1 * 11/2016 Harml ..... A63C 5/12
2017/0049167 A1 * 2/2017 Champagne ..... A41D 19/0096

* cited by examiner

*Primary Examiner* — Michael Zarroli

(57) ABSTRACT

A glove that is worn on the fingers which is capable of being immediately activated, such as through use of a voice-activation system, to provide a non-lethal electrical discharge upon contact with an individual being apprehended, thereby temporarily disabling the individual. The glove has pins on two or more finger portions, and each pin is made from a piece of flat spring metal stamped into a concaved shape. When these come into contact with the person being apprehended, an electric charge is discharged, temporarily paralyzing the body with high voltage electricity. There is a step up circuit with different activation levels, which is voice-controlled. The system also has wireless data storage capabilities, storing glove usage information on a cloud or server. The glove can be used by law enforcement, security, or military personnel for self-defense, to subdue an attacker or to gain greater leverage in a hostile physical situation.

18 Claims, 18 Drawing Sheets

POWER GRIP ZAPPER GLOVE

CROSS-REFERENCE TO RELATED APPLICATION

This application claims priority to U.S. provisional patent application No. 62/108,176, filed on Jan. 27, 2015, the entire disclosure of which is incorporated herein by reference.

FIELD OF INVENTION

The present invention relates generally to an improved non-lethal device for temporarily disabling individuals apprehended by law enforcement. More particularly, the present invention relates to a glove that is worn on the hand which is capable of being immediately activated to provide a non-lethal electrical discharge upon contact with an individual being apprehended, thereby temporarily disabling the individual. The present invention has several configurations and options, including speech recognition technology whereby the electrical discharge can be delivered and controlled via voice commands. Another configuration is wireless technology whereby the device uses a cloud system to store data, and there are additional options whereby the data cannot be erased or modified once recorded. This technology provides law enforcement, military, or security personnel with the ability to protect themselves from a violent attack and to subdue an individual who is aggressive or resisting arrest.

BACKGROUND

Various types of electrical self-defense weapons have existed for years. Typically, law enforcement carries a gun, a baton, Taser® and/or stun guns. In many situations, the use of a revolver is unsuitable because it entails lethal force and may result in serious injury or death. The use of a baton is also inappropriate in many situations, sometimes resulting in too much force thus leading to police brutality or insufficient force such that the police officer ends up being harmed or injured by the assailant.

Taser® or stun guns have seen wide-range applications as a law enforcement tool, and the military, law enforcement and security personnel have shown great interest in Taser® or stun guns for policing actions. Tasers® and stun guns are regularly used by peace officers to humanely capture suicidal or otherwise violent, even armed suspects, without serious injury to suspects, officers or bystanders. However, Taser® and stun guns are ineffective as they cannot be used at a moment's notice because they have to be unsheathed first. Moreover, Taser® and stun guns are bulky, and to be readily accessible for potential application, it must be separately holstered on a utility belt.

Moreover, all the above-described weapons currently being used by police or law enforcement have several additional disadvantages. Significantly, they can ultimately be taken away by an overpowering assailant. They must also be constantly gripped by the user who is restricted from using the same hand and fingers for anything else, providing the user with very limited mobility and versatility.

Another disadvantage is that the above-described weapons do not have the ability or option to be controlled by voice commands. They also do not have the ability or option to transmit and store data wirelessly (such as through a cloud data storage system). The stored data may include the information relating to the identity of the user of the Taser® glove, when (date and time) the glove was used and at what voltage, and when it was turned off.

Thus, there is a need for a non-lethal hand weapon which is versatile, nimble, and effective, and which may be used to immediately control violent, combative or noncompliant individuals to accomplish arrest or detention with no or minimal injury to the individual. There is also a need for a non-lethal hand weapon that has several configurations and options, including voice command control and wireless data storage capabilities.

SUMMARY OF THE INVENTION

It is an objective of the present invention to provide a non-lethal hand weapon in the form of a glove worn by the user which may be used to immediately control violent, combative, or noncompliant individuals to accomplish an arrest or detention with no or minimal injury to the individual.

It is a further objective of the present invention to provide a nimble and effective weapon worn on the hand thereby providing the user with increased mobility, versatility, and use of both hands in an arrest or in a situation where use of one or both hands is necessary to control apprehend an individual, or to defend oneself from a violent or aggressive individual who is resisting arrest.

It is also a further objective of the present invention to provide a non-lethal weapon that is worn on the hand which offers the user more control and that is less likely to be taken away by an overpowering assailant.

It is also a further object of the present invention to provide a configuration of a non-lethal weapon that is voice-activated and voice-controlled, and that can also have a wireless data-storage capability.

The above objectives and other objectives of the present invention are accomplished by providing a glove that is worn on the hand which is capable of being immediately activated to provide a non-lethal electrical discharge upon contact with an individual being apprehended, thereby temporarily disabling the individual. Having this device will give the officer confidence and an edge knowing that they can subdue an individual without having to use lethal force. The device is worn on the hand and is available for use at all times against an assailant at a moment's notice. The glove can be used for self-defense, to subdue or fend off an attacker or to gain greater leverage in a violent or hostile physical situation.

In an embodiment of the present invention, the glove comprises two pins, preferably one on the index finger and the other on the third (or ring) finger, although these pins can be located on any of the fingers. Each pin is made preferably from a piece of flat spring metal stamped into a concaved shape. There is a lancet on the inside of the concaved shaped pin, and this lancet snaps outward when the pins of the glove are pressed against a body part. Each pin is pressure-activated, wherein the metal is shaped in such a way that when pressure is applied by the user to back of the concaved shape pin (or the convex side of said pin), such as when the fingers are pressed against the individual being apprehended, the metal snaps outward, thereby forcing the lancet located on the concaved side forward, pushing the lancet through the glove material so that the lancet can come in contact with the skin of the person being apprehended. In another embodiment of the present invention, the lancet does not penetrate through the glove material, but rather, the glove has a pre-stamped hole which the lancet goes through. Alternatively, rather than sharp lancets or pins, flat discs can be used, which are located on the outside of the glove. These discs can be made circular, and can be made of metal or other similar material known in the art that is capable of conducting electrical waves or electricity.

When the pins or lancets come in contact with the person being apprehended, an electric charge is discharged into the body of the person, temporarily paralyzing the body with high voltage electricity by interrupting communication between the brain and muscles for a short period of time. In another embodiment, an electric charge is sufficiently high in voltage such that an electric charge is discharged into the body of the person, even if the pins (or flat metal circular discs) do not come into direct contact with the skin.

Wiring is connected to both pins, and the wiring runs from the pins, underneath or within the material of the glove, through the sleeve and underneath the shirt of the police officer, to a battery pack worn on the officer's utility belt. In another embodiment of the present invention, the battery pack may be located on an arm band worn by the police officer. Alternatively, the battery pack may be located on the back portion of the hand glove.

In another embodiment, a band (referred to herein as "Nemo Cell"), preferably oval-shaped and made of spring metal, is fitted with a cylindrical tube attached to (such as by welding) the back of the oval-shaped band. One end of the tube is open and the tube is attached to the oval-shaped band. Inside of the Nemo Cell cylinder is a spring (preferably made of metal) and a lancet that is held in place by the spring. When pressure is applied on the sides of the band (such as by squeezing them together) the metal spring extends the lancet forward, through one end of the cylinder, and through a small hole in the glove. When the spring is extended the lancet can come into contact with an individual, wherein upon such contact it administers voltage. The band is attached to a thimble made of graphite or metal lined with insulative material, and is fixed inside the finger tip of a glove. The lancet is wired to a circuit and a battery pack as described below.

In a preferred embodiment of the present invention, the circuit used is a standard stun-gun multi-stage step-up circuit that produces a square-wave output above 10 KHz and a 15-US discharge pulses at a rate above 20 PPM. The pulse fire induces a voltage in the windings of the step-up transformer.

In another embodiment of the present invention, the hand glove of the present invention is capable of administering increasing voltage in response to the assailant's resistance. The circuit incorporates two additional step-up transformers designed to increase the output of the discharge voltage based on the number of times the device is activated.

The battery pack may also incorporate a computer programmed microchip circuit board or a microprocessor that is programmed to release an electrical charge when the circuit is closed by two fingers coming into contact with an individual's body. It can also be designed to respond to the number of times the wiring circuit is opened and closed. The length of the electrical charge is administered for a predetermined period of time and can be programmed to administer a second charge and third charge automatically, after the first predetermined period of time has timed out or run out.

In one embodiment of the invention, the system is voice-activated and voice-controlled, whereby the system is capable of recognizing the voice of the speaker (or user) over other background voices, noises or sounds. The system allows the speaker to give voice commands to the device such as to activate it, administer increasing voltage, and to stop or disable the device. The voice activation system may also be programmed so that the unit or glove system is user-specific, such that it can only be used by a particular, designated person, and will not be activated by other voices. The voice-activated system may also include password-protected options whereby the user will first be prompted to state certain words (to assist in the recognition of the user's voice) and/or provide a password before the system is activated for use. The speech recognition software used to implement this feature are those that are known in the art, such as but not limited to, LumenVox, Dragon, Nexidia, and Rubidium software application programs.

In another embodiment of the invention, the system is capable of storing information. Information may be stored in the device itself (such as via a microprocessor), or wirelessly, such as to a cloud. The information stored may include the identity of the user of the glove system, details regarding when the system was turned on or activated, details regarding the voltage levels administered, and the associated date, time, length of voltage administration and user information. And in some embodiments, in order to maintain integrity of the information stored (such as for later potential use as evidence), the data, once stored, may not be modified or deleted.

In another configuration, the information stored may also be transmitted wirelessly to a cloud or remote server. The data may be accessed and downloaded from a website or intranet site (e.g., a police department intranet/internal network system), such as through a password-protected and firewalled cloud storage system, which is known in the art.

These and other configurations, embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the following accompanying drawings:

FIG. 8 is another embodiment of the hand glove, wherein it has pre-stamped holes which the lancet goes through;

Figure 1:
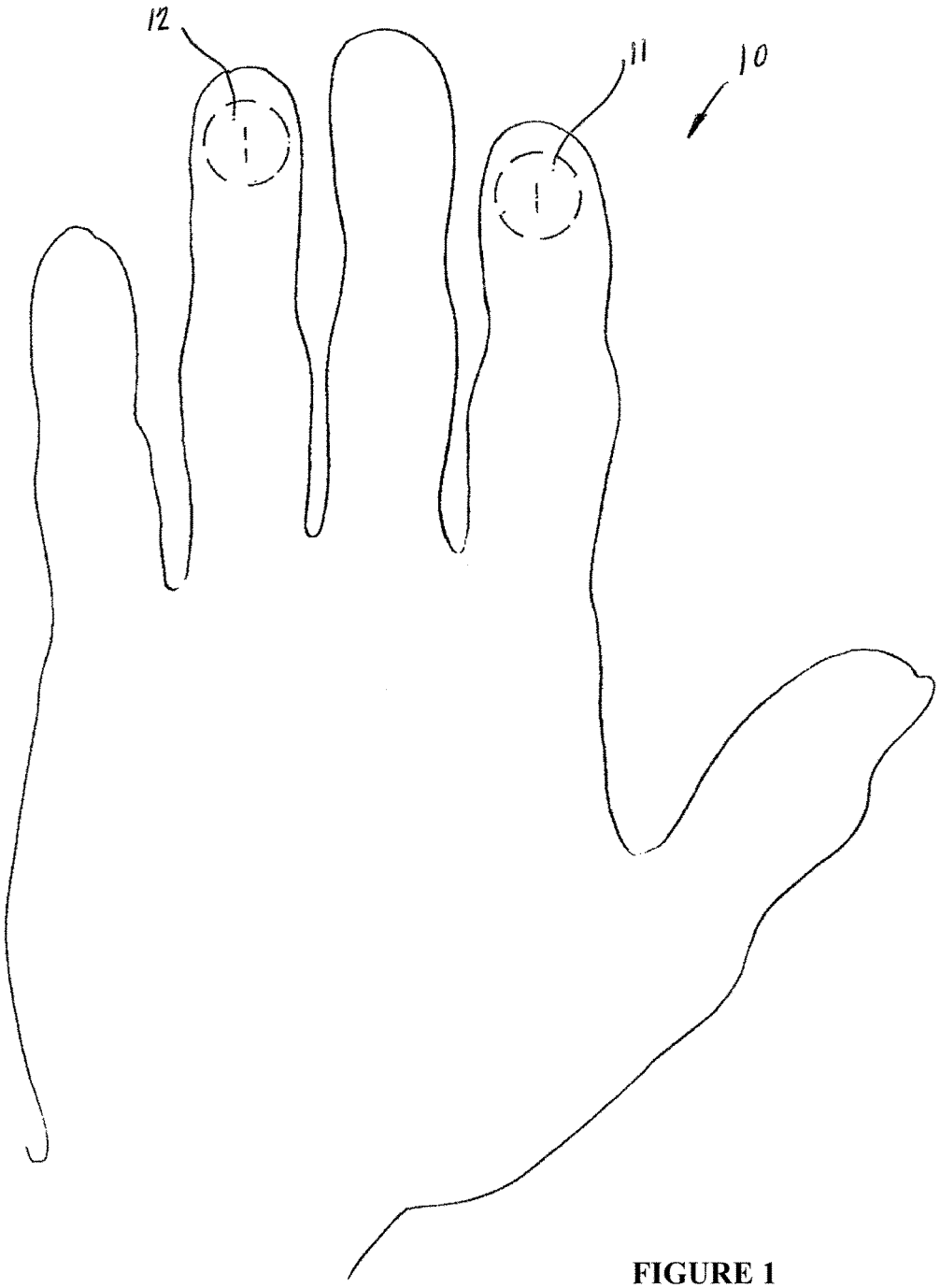
FIG. 1 is a palm side view of the hand glove of the present invention, showing the pins in the interior of the glove.

Reference symbols or names are used in the Figures to indicate certain components, aspects or features shown therein. Reference symbols common to more than one Figure indicate like components, aspects or features shown therein.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to the drawings, FIG. 1 shows a palm side view of the hand glove of the present invention. In an embodiment of the present invention, the glove 10 comprises at least two pins, preferably a first pin 11 on the index finger and a second pin 12 on the third or ring finger. The pins may be located on any of the glove fingers, or any two of the glove fingers, but the index and third or ring fingers are the preferred locations. The glove 10 is preferably made of material such as leather, but other materials that are insulative and provide grip may be used. The glove 10 substantially covers each of the five fingers. Gripping material may also be incorporated onto the palm side of the glove 10 to aid in its gripping capability. The pins 11 and 12 may be mounted on an insulative material, such as neoprene, rubber, or similar material for insulation of the hand of the user from the pins. The glove 10 may also have snaps, fasteners, Velcro®, or elastic band or material around the wrist area to secure the glove over the hand so that it is not easily removed by the assailant during a struggle with the police officer wearing the glove.

Figure 2:
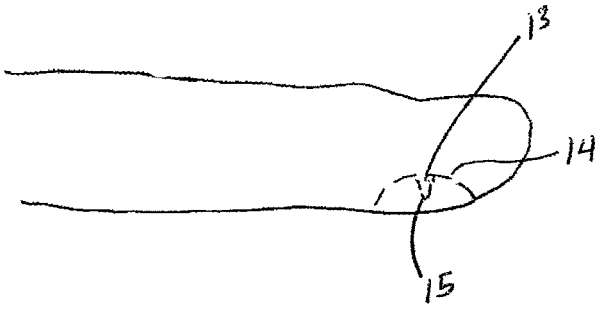
FIG. 2 is a side view of a pin of the hand glove of the present invention, in a concave position, before pressure is applied to the pin.
Figure 3:
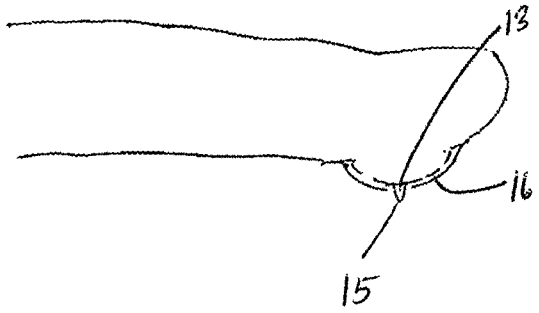
FIG. 3 is a side view of a pin of the hand glove of the present invention, in a convex position, after pressure is applied to the pin.
Figure 4:
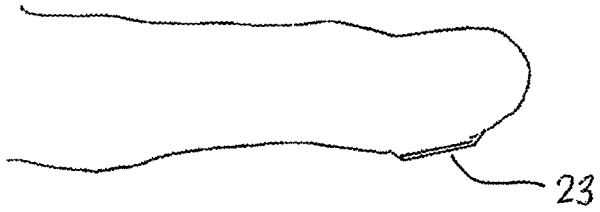
FIG. 4 is a side view of an embodiment of the present invention, comprising a flat metal circular disc on the outside of the glove.

Referring to FIGS. 1, 2 and 3, each pin 11 and 12 is made from a piece of flat spring metal (or other materials known in the art which have properties similar to those described herein) stamped into a concaved shape. In a preferred embodiment, the metal is stamped into a concaved shape that is approximately 0.3 mm in depth and approximately 2 mm in diameter, with a flat rim of approximately 0.25 mm. There is a lancet 13 on an interior portion of the concaved shaped pin. The lancet 13 is made of metal, or an alloy, or similar material that has conductive properties, and has a sharp point or a point that is sufficiently sharp to penetrate through the glove material. In an embodiment, the lancet 13 is approximately 2.5 mm in length. The lancet 13 may be welded onto the pin, or attached to the pin so long as the lancet (or a portion thereof) is in direct contact with the pin. In another embodiment, rather than sharp lancets or pins, flat metal circular discs 23 can be used, which are located on the outside of the glove, as shown in FIG. 4. In another embodiment, these metal discs which are outside of the glove may be stamped into a concaved shape, and are also pressure-activated, as described below.

Each pin is pressure-activated. As shown in FIG. 2, before activation, or before any pressure is applied by the user, the pins 11 and 12 are in a concave position 14. The lancet 13 is on the inside of the concaved shaped pin, and its tip 15 is not exposed from the surface of the glove. As shown in FIG. 3, upon activation, or when the pins of the glove are pressed against a body part surface, and pressured is applied to the back of the concaved shape pin on its convexed side 16 by the hand of the user, the metal snaps outward into a convex position 17, thereby forcing the lancet 13 forward, pushing the lancet through the glove material (and through clothing that the person being apprehended is wearing) so that the lancet 13 can come in contact with the skin of the person being apprehended. When the lancets come in contact with the skin of the person being apprehended, an electric charge is discharged into the body of the person, temporarily paralyzing the body with high voltage electricity by interrupting communication between the brain and muscles for a short period of time.

In other embodiments of the present invention, the pins 11, 12 and/or 23 or lancets 13 do not have to come in contact with the skin wherein even in a situation where the assailant or attacker is wearing a heavy down jacket (such as when the pins are a good two inches from any point near the skin), the impact of the electrical charge will still administer a similar effect wherein the individual will lose muscle control. The pins 11, 12 and/or 23 or lancets 13 do not have to be penetrating the skin, nor touching skin to work. In these embodiments (which are well within the knowledge of one of ordinary skill in the art), the voltage of the electric discharge must be sufficiently high so as to administer a similar effect even without touching the skin.

Figure 5:
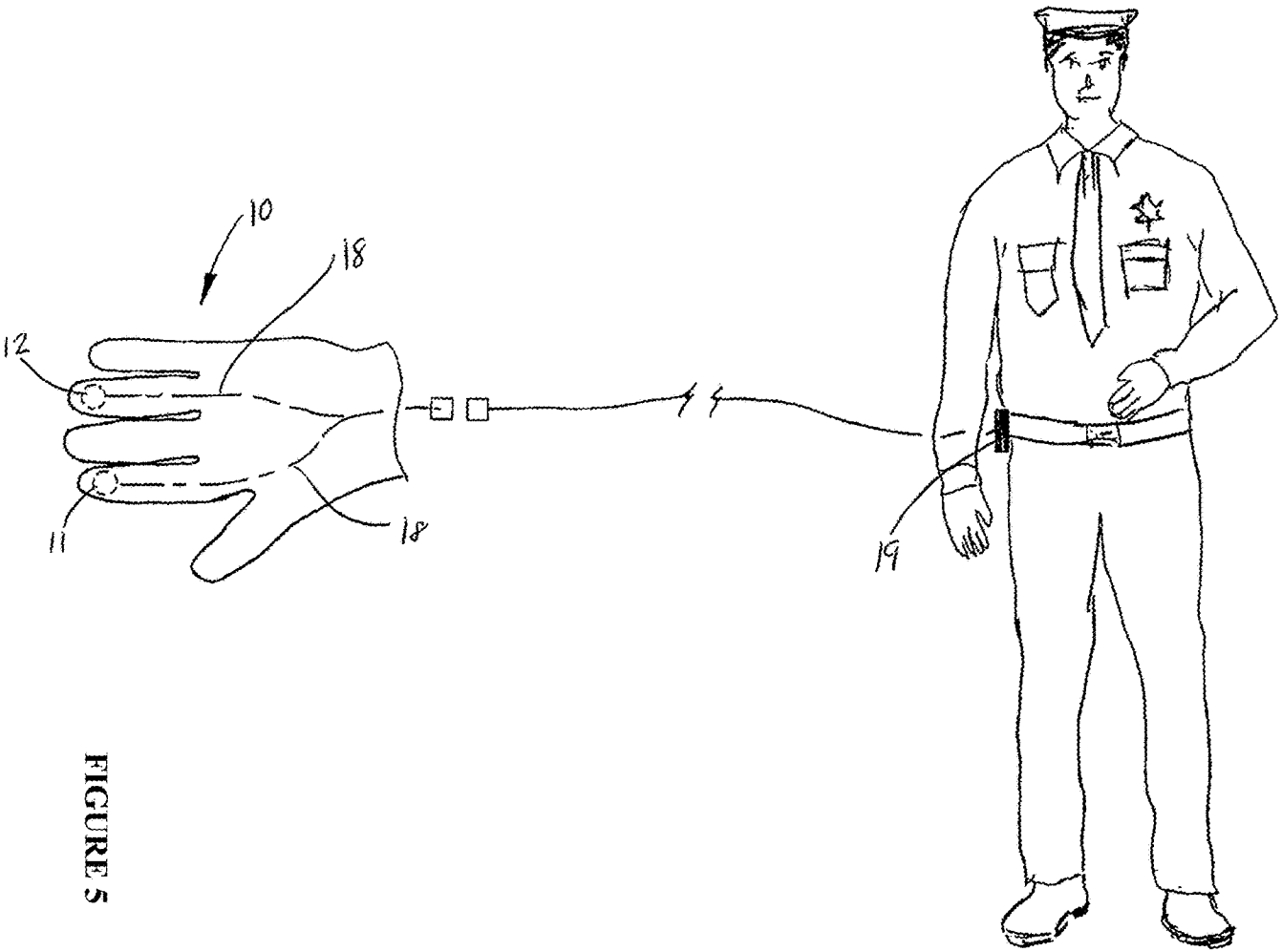
FIG. 5 is the electrical circuit of the hand glove of the present invention.

As shown in FIG. 5, wiring 18 is connected to both pins 11 and 12, and the wiring runs from the pins, underneath or within the material of the glove 10. The wiring runs through the arm, to the sleeve and underneath the shirt of the police officer, to a battery pack 19 worn on or holstered to the officer's utility belt.

Figure 6:
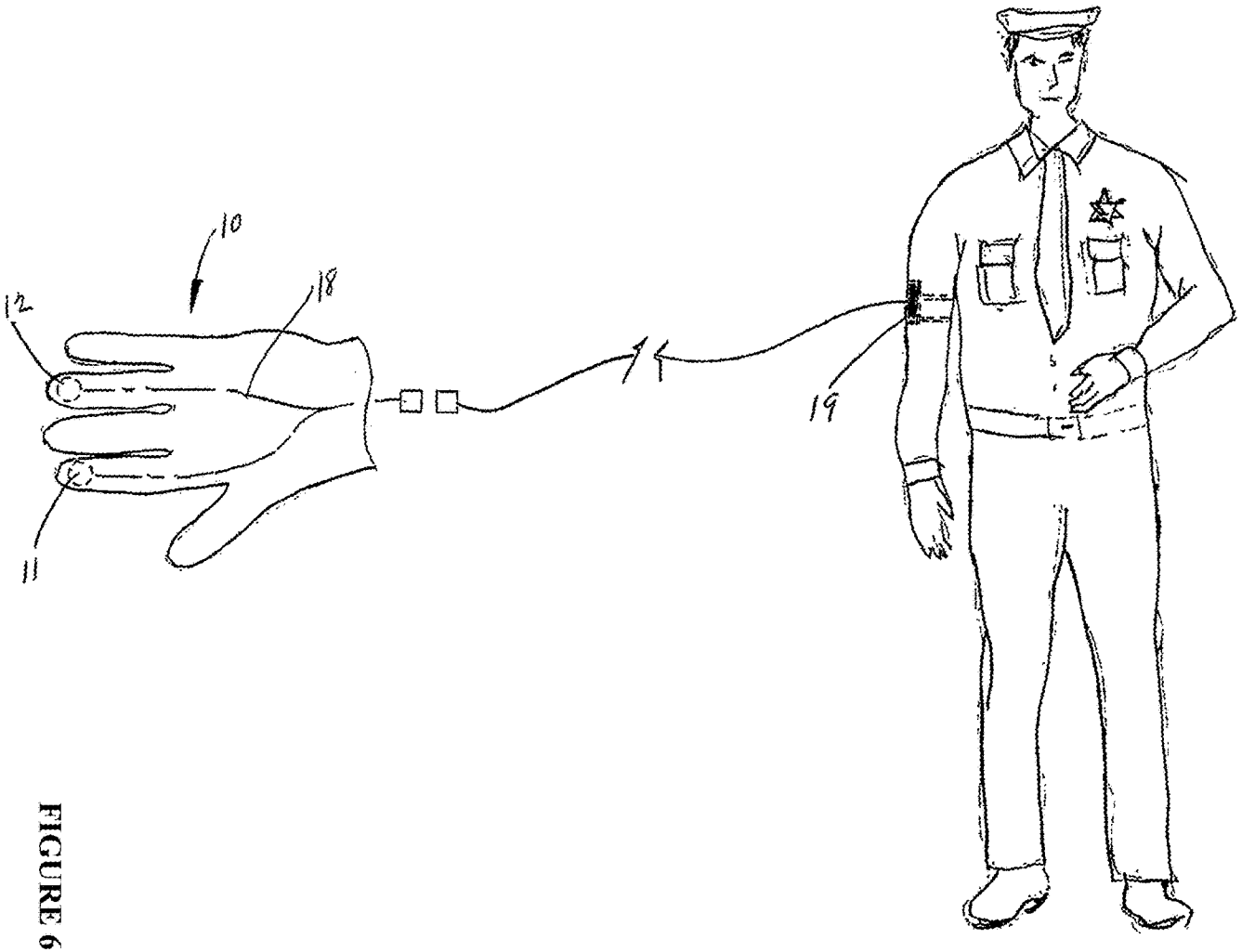
FIG. 6 is the electrical circuit of the hand glove of the present invention, with a battery pack incorporated into an arm band that is worn by the person wearing the hand glove.

As shown in FIG. 6, in another embodiment, the battery pack 19 may be located on an arm band 20 worn by the police officer wearing the glove 10.

Figure 7:
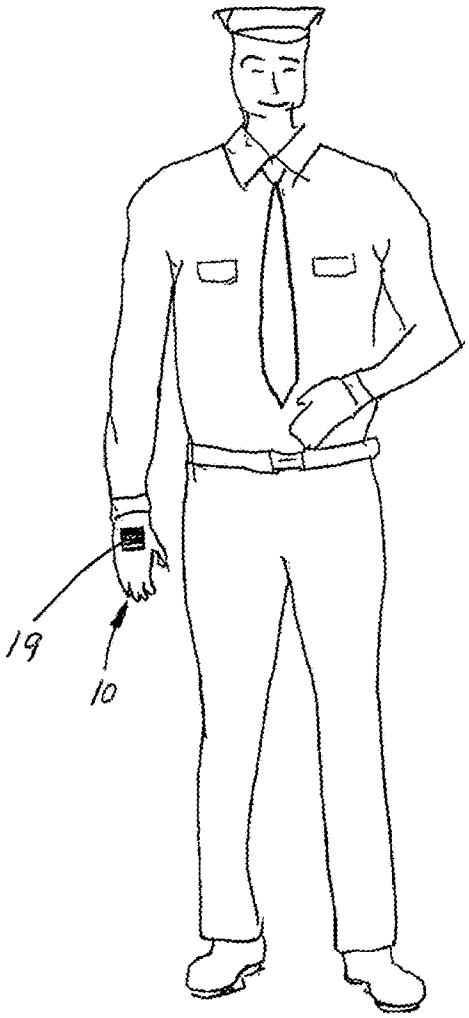
FIG. 7 is the electrical circuit of the hand glove of the present invention, with a battery park incorporated onto the back of the hand of the person wearing the hand glove.

As shown in FIG. 7, in another embodiment of the present invention, the battery pack 19 may be located on the back of the hand of the person wearing the hand glove. The battery pack may be attached to the outside of the glove through Velcro®, fasteners, stamps, or in yet another alternative embodiment, inserted into a pocket outside of the glove.

Figure 8:
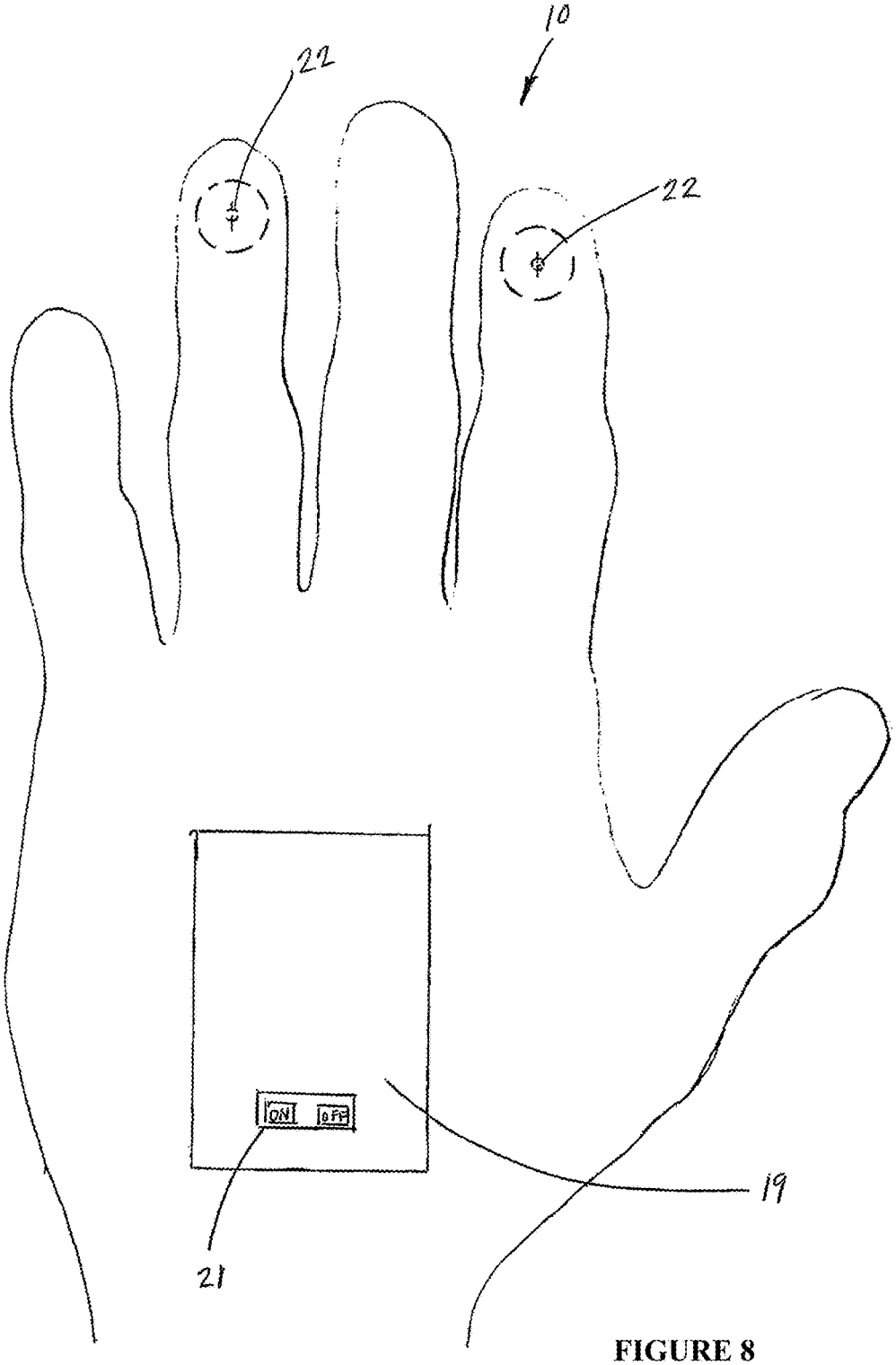

As shown in FIG. 8, in another embodiment of the present invention, the lancet does not penetrate through the glove material, but rather, the glove 10 has a pre-stamped hole 22 which the lancet goes through. The pre-stamped hole may be metal-stamped, or stamped wherein the hole is surrounded by plastic, neoprene, or other insulative material.

The battery pack 19 may be made of conventional battery (9 volt or higher) that is used for stun guns, and may include a computerized battery charging system that can be charged such as through a USB charger (similar to what is used with a phone charger) plugged into an electrical wall outlet, or into a cigarette lighter. In the embodiment shown in FIG. 8, the battery pack 19 is located on the back portion of the hand of the person wearing the hand glove. The battery pack also contains an on and off switch 21 to turn the power source on and off. The on and off switch can be located on any portion of the battery pack. Switching on the switch will allow electrical power to be supplied through the wires and to the pins so that the pins can be on stand-by and be immediately activated upon application of pressure. Switching off the switch will close the power supply to the pins. However, in the preferred embodiment, even when the switch is switched on, electrical discharge would not be generated unless both pins touch the surface of the skin of the person being apprehended. The pins have to be in a closed position to complete the circuit and generate an electrical discharge.

Figure 9:
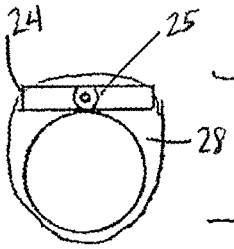
FIG. 9 is a front view of another embodiment of the present invention (called "Nemo Cell")
Figure 10:
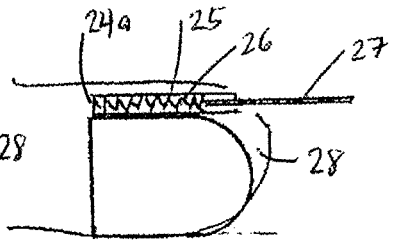
FIG. 10 is a side view of the embodiment shown in FIG. 9, wherein a spring and a lancet are shown in an extended position.
Figure 11:
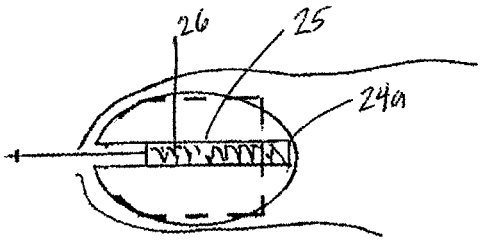
FIG. 11 is a top view of the embodiment shown in FIGS. 9 and 10, wherein the spring and the lancet are shown in an extended position.
Figure 12:
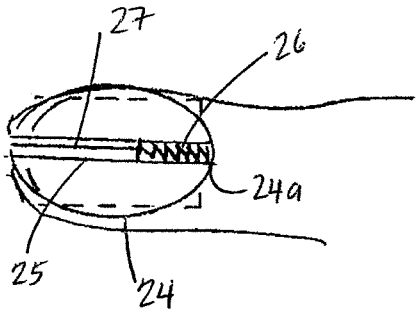
FIG. 12 is a top view of the embodiment shown in FIGS. 9, 10, and 11, showing the spring and the lancet in a cylindrical tube within the Nemo Cell.
Figure 13:
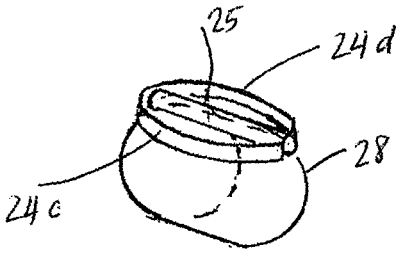
FIG. 13 is a perspective view of the embodiment shown in FIGS. 9 through 12.

Shown in FIGS. 9 through 13 is another embodiment of the present invention. In this embodiment, a band (called "Nemo Cell") 24 preferably in the shape of an oval and made of spring metal is fitted with a cylindrical tube 25 attached (such as by welding) to the back end 24*a* of the oval-shaped band. The cylindrical tube may also be attached to the front end 24*b* of the oval-shaped band. One end of the cylindrical tube is open. Inside the Nemo Cell cylinder is a spring 26 (preferably made of metal) and a lancet 27 that is held in place by the spring. When pressure is placed on both sides 24*c* and 24*d* of the oval-shaped band (such as by squeezing both sides together), the metal spring forces the lancet forward, such as through a small hole in the glove. When the spring is fully extended the lancet can come into contact with an individual to administer the electrical shock. The cylindrical tube 25 is approximately 1.25 mm in diameter X 2.5 mm in length. The lancet is approximately 2 mm in length. In a preferred embodiment, the Nemo Cell is attached to a thimble 28 which is preferably made of a graphite or metal lined with an insulating material, or other material known in the art with insulative properties, and is fixed inside the glove finger tip. As shown in FIGS. 9, 10 and 13, the oval-shaped band 24 and the cylindrical tube 25 containing the spring 26 and lancet 27 are located on top of the thimble 28.

In various embodiments, the glove can have two to four Nemo Cells that are placed on the tips of the fingers such as the thumb and pinky finger, and the sides of each band are squeezed together to release the lancet. This is the activated position. In these embodiments, the Nemo Cell is designed so that the lancet can be deactivated by springing it in or pushing it back into the cylinder and reset for future use. This deactivation can be done by squeezing the sides of each band after activation, thus springing the lancet back in, or by manually pushing the lancet into the cylinder.

The Nemo Cells are located within the glove, allowing the wearer to have full use of the hand to perform many functions, such as driving, holding a cup, holding a baton, holding a gun, writing, at the same time permitting activation by applying pressure to the oval shaped band made of spring metal, to release the lancet to apprehend an individual, or defend against physical attack.

The Nemo Cells are preferably hidden from view so as to allow the wearer to interact with the public in a non-threatening manner. When the zapper glove is in a stand by mode, it gives the wearer confidence that they can subdue a combative individual at a moment's notice.

Figure 14:
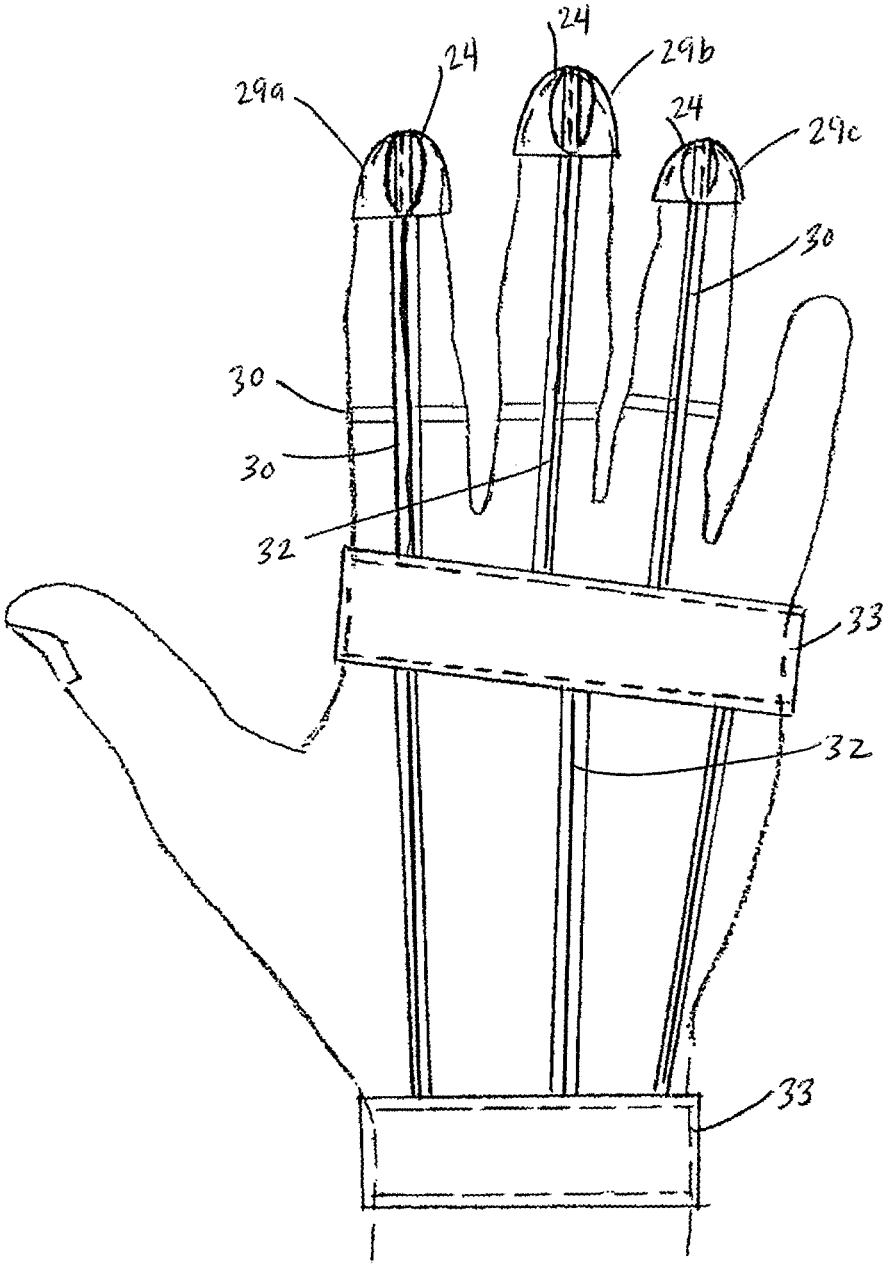
FIG. 14 is a top view of another embodiment comprising finger tip thimbles.
Figure 15:
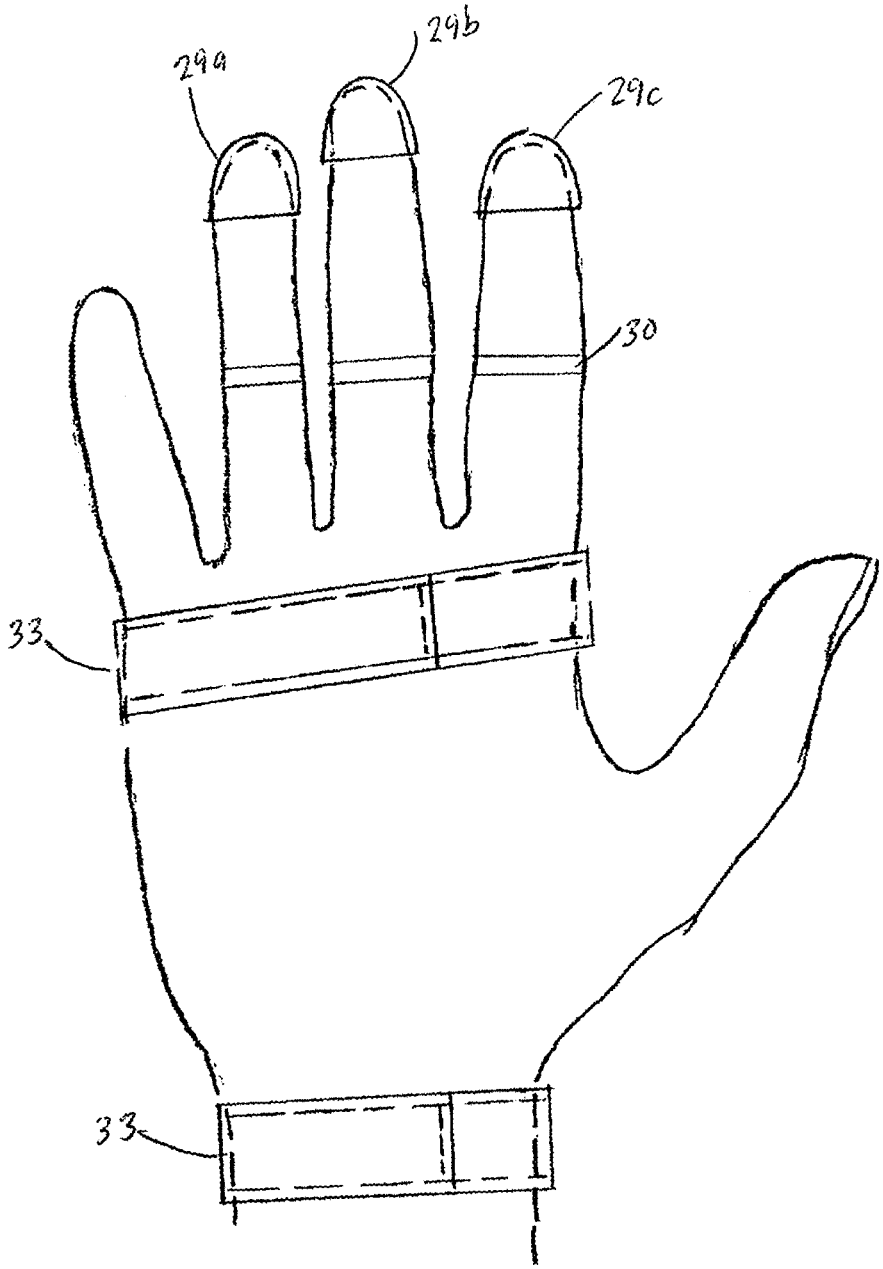
FIG. 15 is a bottom view of the embodiment shown on FIG. 14.

Referring to FIGS. 14 and 15, another embodiment is shown comprising of thimbles 29*a*, 29*b*, and 29*c*, covering only the finger tips. These thimbles can incorporate the oval shaped band 24 of the Nemo Cells, as described above, or the concave/convex pins as also described above. The thimbles are connected to wiring 32, which can be covered by cloth or similar insulative material. The thimbles are secured to the finger tips by their shape, and are further secured by strips of material 30 made of insulative material such as cloth, leather, polyurethane, or silicon. These strips run along the top of the fingers, or can cover the entire finger. Wiring 32 is located underneath or within the strips, and the strips and wiring are secured to the fingers, palm and wrist, such as through use of a Velcro® strap 33. The wiring connects to a battery pack which may be located on an arm band worn by the police officer, such as that shown in FIG. 6. The wiring may also be run through the arm, to the sleeve and underneath the shirt of the police officer, to a battery pack worn on or holstered to the officer's utility belt, such as that shown in FIG. 5. Alternatively, the battery pack may be on the back of the hand as shown in FIG. 7. The embodiment shown in FIGS. 14 and 15 can incorporate the multi-stage step-up circuit described below.

In a preferred embodiment of the present invention, the circuit used is a standard stun-gun multi-stage step-up circuit that produces a square-wave output above 10 KHz and a 15-US discharge pulses at a rate above 20 PPM. The pulse fire induces a voltage in the windings of the step-up transformer.

In several embodiments, the hand glove of the present invention is capable of administering increasing voltage in response to the assailant's resistance. In these embodiments, the circuit incorporates two additional step-up transformers designed to increase the output of the discharge voltage based on the number of times the device is activated. Activation is dependent upon the two pins 11 and 12 (or the lancet tip 15 of each of these pins) coming in contact with an individual. The following is an example of an increased output corresponding to a progression of activation sequences:

(1ST ACTIVATION) 450,000 VOLTS; APPLICATION TIME: 10 SECONDS;

(2ND ACTIVATION) 1,000,000 VOLTS; APPLICATION TIME: 10 SECONDS;

(3RD ACTIVATION) 2,000,000 VOLTS; APPLICATION TIME: 10 SECONDS.

The following is another example of an increased output corresponding to a progression of activation sequences:

(1ST ACTIVATION) 20,000,000 VOLTS; APPLICATION TIME: 10 SECONDS;

(2ND ACTIVATION) 30,000,000 VOLTS; APPLICATION TIME: 10 SECONDS;

(3RD ACTIVATION) 53,000,000 VOLTS; APPLICATION TIME: 10 SECONDS.

If the $1^{st}$ activation is held in place with the pins (or lancets) in contact with an individual, the voltage remains at the $1^{st}$ activation level until released or timed-out. The voltage is increased upon the $2^{nd}$ and $3^{rd}$ activation levels (or additional subsequent levels) upon simultaneous tapping of the pins (or lancets) against the body of the individual being subdued.

In operation, once the glove is activated, or once both pins (or lancet tips) touch the assailant's skin surface, the battery pack supplies power to the wiring, supplying an electrical discharge between the two pins (or two lancets) that can be between 15,000,000 or 40,000,000 volts, or an even greater non-lethal voltage typically applied by stun guns in the market. The space between the two lancets also allows for moving electrical current to pass between them, and the assailant is shocked as the assailant's skin facilitates completing the circuit between the pins, and the electrical discharge enters the skin and immobilizes the assailant.

In several embodiments, the battery pack 19 incorporates a computer programmed microchip circuit board that is programmed to release an electrical charge when the circuit is closed by two fingers coming in contact with an individual body. In these embodiments, the circuit board is designed to respond to the number of times the wiring circuit is opened and closed. For instance, the length of the electrical charge is administered for a predetermined period of time (such as 10 seconds), and if the officer cannot (or does not) remove his fingers from the assailant after the 10 second timeout, the computer will open the circuit. However, if the fingers remain on the assailant for an additional five 5 seconds then the computer is programmed to administer the second charge and subsequent third charge automatically. The subsequent electric charges may be of the same voltage, or increasing voltage.

In another embodiment, the present invention incorporates a voice-activated and voice-recognition system. In this embodiment, the system has an authentication step which recognizes certain voice recognition commands, such as (for illustration purposes only): ON, level 1, level 2, level 3, and OFF. The speaker will repeat these commands until the program recognizes the voice pattern, such that only the same speaker will be able to activate the program and will have use of these five voice recognition commands. The program can also have an optional password recognition feature, whereby the speaker (or user) states "password" and the pre-programed password to activate the system. The user may also state his or her user name before the password for authentication purposes. The password may be programmed as known in the art for such voice/speech recognition programs, utilizing speech recognition program(s) known in the art, such as, but not limited to LumenVox, Dragon, Nexidia, and Rubidium software application programs. Alternatively, the user name and password may be entered using a key pad that is attached to the circuitry of the present invention, such as via a USB connector. The hardware of the present invention also has a microphone for capturing voice commands.

Figure 16:
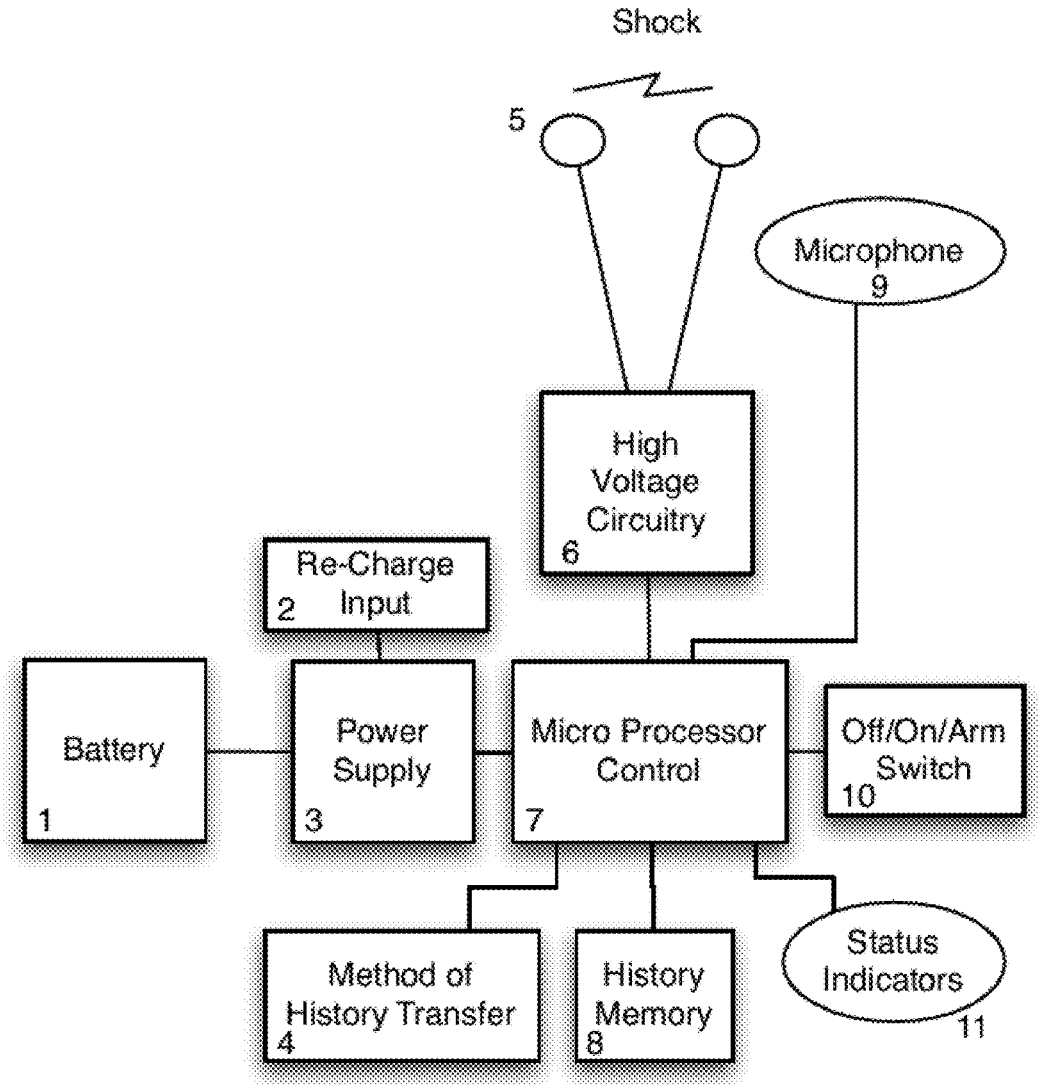
FIG. 16 is a block diagram of an embodiment of the present invention that has a voice-activation and information storage features.

Referring now to FIG. 16, it is a block diagram of an embodiment of the present invention that has a voice-activation and information storage features. In this embodiment, the source of energy for the device is a rechargeable battery (1) which is connected to a regulated power supply (3). An input to the power supply (2) is used to recharge the battery. An embedded microprocessor (7) controls the high voltage circuitry (6) to deliver a shock (5). The shock is initiated via voice commands from a microphone (9), utilizing a speech recognition software known in the art which is programmed within the microprocessor. The data showing the history of how many shocks and what level they were given (and optionally, the date and time when the unit was activated and used) is recorded on an on-board history memory (8) which is initiated by the microprocessor control (7). The microprocessor has a means to transfer this data history in a wired or wireless manner (4), onto a cloud or a remote server. The data history can also be saved such as onto a USB storage device. A manual switch (10) toggles modes (such as on/off/arm switch). Status indicators (11) present the user with a means to know what mode the unit is in (e.g., through different colored lights, blinking frequency). For example, in a configuration with three levels of operation, such as the step up circuit with three different activation levels discussed above, a small yellow light shows that the unit is armed. The speed or flashing frequency of the light shows different voltage levels. For example, the higher the flashing frequency, the greater the voltage level is. A red light indicator may be used to indicate when the battery is low.

Figure 17:
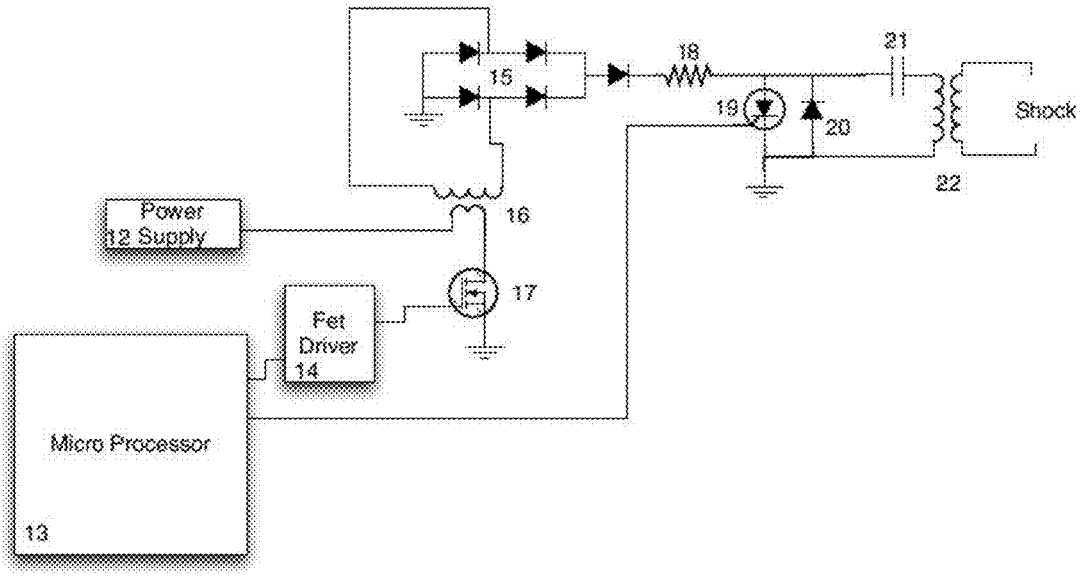
FIG. 17 is a circuit diagram of an embodiment of the present invention that has a voice-activation and information storage features.

Referring now to FIG. 17, it is a circuit diagram of an embodiment of the present invention that has a voice-activation and information storage features.

The microprocessor (13) pulses the FET driver (14) which drives the gate on the transistor to turn on and off (17). When this switch turns on and off current pulses fed from the power supply (12) cause a high voltage AC waveform to appear on the rectifying diodes (15). A resistor (18) limits the current flowing into the capacitor (21). When the capacitor (21) is charged to a high voltage, the microprocessor toggles the SCR (19) on. The SCR (19) quickly discharges the capacitor causing a high current through the high voltage output inductor (22). A small diode (20) allows current to flow back up to the capacitor to deal with small inductances in the wiring. This high current in the output inductor (22) induces a high voltage on the output and a shock.

Figure 18:
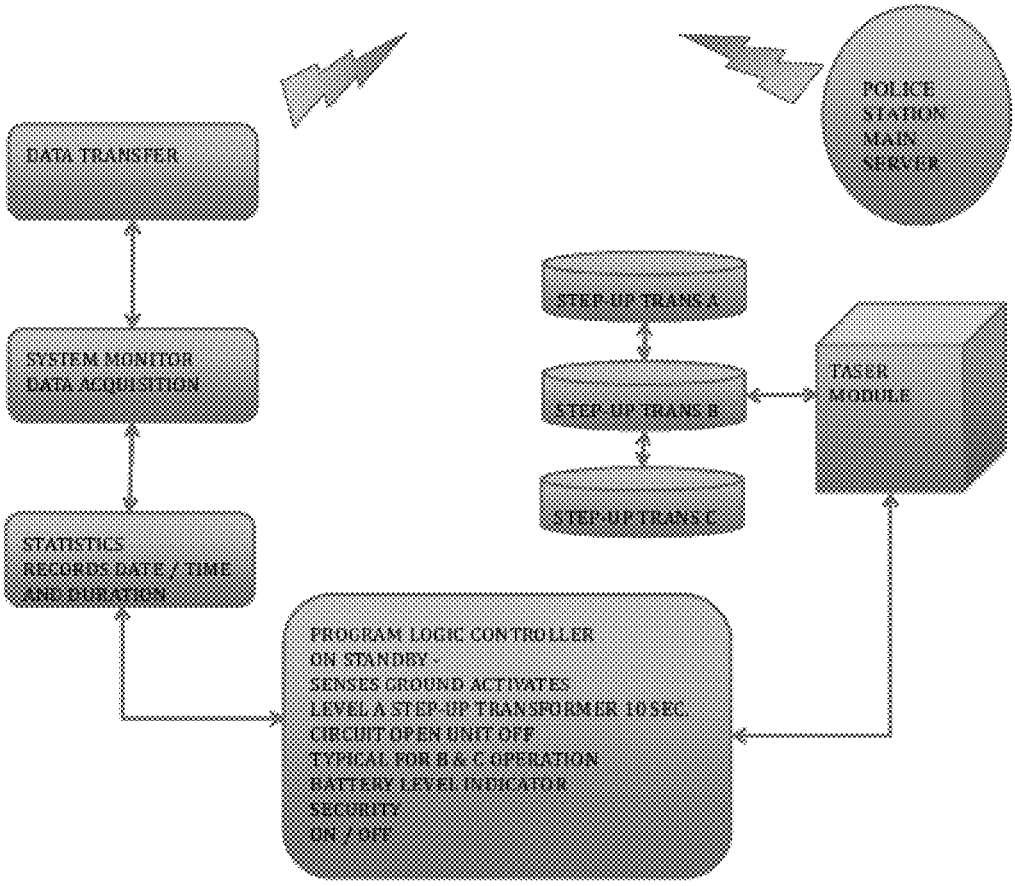
FIG. 18 is a block diagram of an embodiment of the present invention that has voice-activation and information storage features.

Referring to FIG. 18, it is a block diagram of an embodiment of the present invention that has voice-activation and information storage features. When there is an emergency, the police station main server dispatches information relating to the emergency, such as location, assailant information, and type of crime that is being committed. This information is communicated to the police officer via information wirelessly transmitted to a police computer, or through police radio networks. The police officer(s) then respond to the emergency by activating the glove system of the present invention. In this configuration of the present invention, this is done through voice activation (e.g., speaker saying "ON", and the voice activation software processes that information to activate or turn on the system; alternatively, a password may be stated by the speaker which then activates the system). The hand glove is capable of administering increasing voltage in response to the assailant's resistance. The circuit incorporates a step-up transformer (transformer A) and, in this embodiment, two additional step-up transformers (transformers B and C), for a total of three, designed to increase the output of the discharge voltage based on the number of times the device is activated. The speaker states "level 1", which is recognized by the speech recognition program, and the system is then activated to provide an electrical discharge at a specified voltage level (e.g., 20,000,000 VOLTS). The speaker states "level 2", which is recognized by the speech recognition program, and the system is then activated to provide an electrical discharge at the next specified voltage level (e.g. 30,000,000 VOLTS). The speaker states "level 3", which is recognized by the speech recognition program, and the system is then activated to provide an electrical discharge at the next specified voltage level (e.g., 52,000,000 VOLTS). The built-in microprocessor then records data comprising the history of activation (such as date and time when the system was turned on) and the history of voltage levels activated and the date and time when a particular voltage level is activated, and the duration when each such voltage is discharged. It also records the date and time when the system was turned "off". As an additional option, the microprocessor also records the user's (or speaker's) identity. This information can then be transmitted wirelessly to a remote server, or to a cloud storage system where such data can later be retrieved for use as evidence. The microprocessor can be any microprocessor known in the art that can record and/or store the type of data that is generated by use of the glove system (e.g., voltage levels activated, date and time information, device activation and deactivation, and user or device information).

Figure 19:
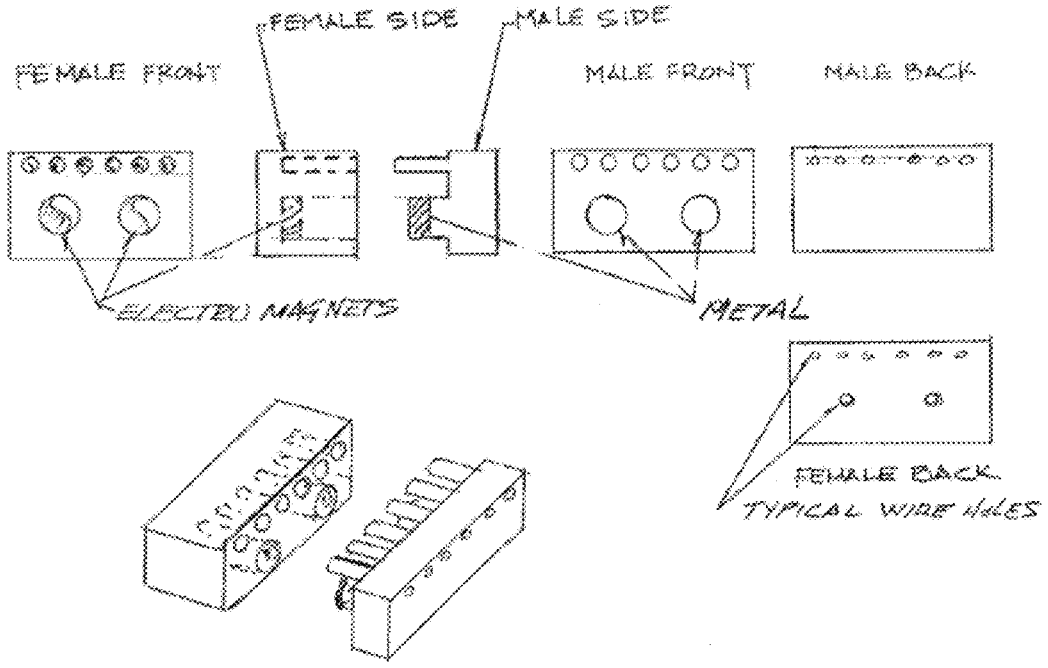
FIG. 19 is a plan view of male and female wiring harnesses used to connect and disconnect the glove from the wiring harness in an embodiment of the present invention.

Referring to FIG. 19, it depicts a plan view of male and female wiring harnesses used to connect and disconnect the glove (or the pins) from the wiring harness in an embodiment of the present invention. Standard wiring harnesses use plastic or neoprene clips that require both hands to connect or disconnect them. However, in this configuration of the present invention, electromagnets are used to secure the male and female wiring harnesses, thus, only requiring one hand, if at all, (or a finger) to release them from each other after the electrical field is de-energized. When the male and female wiring harnesses are connected to the circuitry of the glove system, an electrical charge is provided to the metal disk in the female harness. This charge is provided by the power source such as a rechargeable battery used to power the glove system. When the male harness is positioned adjacent to the female harness, the magnetic field generated by the female energized harness will pull the male metallic pin into position. The electrical magnetic field will hold the male and female harnesses in place until the electrical field is de-energized, releasing the male and female harnesses from one another. This additional feature is designed to allow a more convenient method of securing the male and female harnesses and to uncouple them with little resistance. Thus, with this electromagnetic-activated connection, use of both hands is unnecessary to disconnect the glove from the wiring system, and the police officer can use his free hands for other applications.

This written description uses examples to disclose the invention, including the best mode, and also to enable any person skilled in the art to practice the invention, including making and using any devices or systems and performing any incorporated methods. Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A power grip zapper glove system comprising:

a first pin and a second pin, wherein the first pin is on an index finger portion of the glove, and wherein the second pin is on another finger portion of the glove;

wherein each pin comprises a metal stamped into a concave shape;

a lancet on an interior portion of the first pin;

a lancet on an interior portion of the second pin;

a battery pack which provides power to the first pin and to the second pin;

wiring which connects the first pin and the second pin to the battery pack;

wherein the first pin and second pin are pressure-activated such that when the first pin and the second pin are pressed against a skin surface and pressure is applied to a convexed side of the first pin and to a convexed side of the second pin, each of these pins snaps outward into a convex position, thereby forcing the lancet forward, pushing the lancet through the glove; and wherein the first and second pins are capable of administering an electric voltage through tapping the first pin and the second pin simultaneously against a skin surface.

2. The power grip zapper glove system of claim 1 further comprising three step-up transformers to increase the output of the discharge voltage based on the number of times the first pin and second pin are activated.

3. The power grip zapper glove system of claim 1 further comprising an arm band which holds the battery pack.

4. The power grip zapper glove system of claim 1 wherein the first and second pins are capable of administering increasing voltage through tapping the first pin and the second pin simultaneously against the skin surface.

5. The power grip zapper glove system of claim 1 further comprising a speech recognition program that is integrated into the wiring; and a microphone, whereby the electrical discharge can be delivered and controlled via voice commands.

6. The power grip zapper glove system of claim 1 further comprising a microprocessor which is capable of storing information relating to usage of the glove.

7. The power grip zapper glove system of claim 1 further comprising an electromagnetic male and female wiring harness.

8. A glove system comprising:

an insulative material that covers a portion of at least two fingers;

a first pin and a second pin, wherein the first pin is on an index finger portion of the insulative material, and wherein the second pin is on another finger portion of the insulative material;

wherein each pin comprises a flat disc on an outside of the finger portions of the glove;

a battery pack which provides power to the first pin and to the second pin;

wiring which connects the first pin and the second pin to the battery pack;

a circuit board that is designed to administer increasing voltage through the wiring and to the first pin and to the second pin;

a microphone;

a microprocessor configured to record and store data; and a speech recognition software program whereby the system is activated through instructions given by a user through voice commands into the microphone.

9. The glove system of claim 8 wherein the circuit board is designed to administer increasing voltage upon simultaneous tapping of the pins against a person's skin.

10. The glove system of claim 8 further comprising an electromagnetic male and female wiring harness used to connect and disconnect the first pin and the second pin from the battery pack.

11. The glove system of claim 8 wherein the microprocessor is capable of transmitting stored data wirelessly to a remote server.

12. The glove system of claim 8 wherein there are three step-up transformers to increase the output of the voltage that is discharged based on the number of times the first pin and second pin are activated.

13. The glove system of claim 8 wherein the data recorded and stored by the microprocessor includes voltage levels activated, device activation and device deactivation, and associated date and time information.

14. The glove system of claim 8 wherein:

the voice command "ON" is recognized by the speech recognition program, and the system is then activated to provide an electrical discharge at a specified voltage level.

15. The glove system of claim 8 wherein:

the voice command "level 1" is recognized by the speech recognition program, and the system is then activated to provide an electrical discharge at a specified voltage level.

16. The glove system of claim 15 wherein:

the voice command "level 2" is recognized by the speech recognition program, and the system is then activated to provide an electrical discharge at a voltage level that is higher than an initial voltage level.

17. The glove system of claim 16 wherein:

the voice command "level 3" is recognized by the speech recognition program, and the system is then activated to provide an electrical discharge at a voltage level that is higher than the voltage level than the "level 2" voice command.

18. The glove system of claim 17 wherein:

the voice command "OFF" is recognized by the speech recognition program, and the system is then turned off.

* * * * *